US010676936B2

(12) United States Patent
Lemiegre et al.

(10) Patent No.: US 10,676,936 B2
(45) Date of Patent: Jun. 9, 2020

(54) SCREEN DEVICE

(71) Applicant: RENSON SUNPROTECTION-SCREENS NV, Waregem (BE)

(72) Inventors: Kristof Lemiegre, Waregem (BE); Thierry Veys, Waregem (BE); Bart Abeel, Waregem (BE)

(73) Assignee: RENSON SUNPROTECTION-SCREENS NV (BE)

( * ) Notice: Subject to any disclaimer, the term of this patent is extended or adjusted under 35 U.S.C. 154(b) by 441 days.

(21) Appl. No.: 15/577,762

(22) PCT Filed: May 23, 2016

(86) PCT No.: PCT/IB2016/053012
§ 371 (c)(1),
(2) Date: Nov. 28, 2017

(87) PCT Pub. No.: WO2016/189450
PCT Pub. Date: Dec. 1, 2016

(65) Prior Publication Data

US 2018/0127982 A1 May 10, 2018

(30) Foreign Application Priority Data

May 28, 2015 (BE) ..... 2015/5334

(51) Int. Cl.
*E04C 3/12* (2006.01)
*E04F 10/10* (2006.01)
(Continued)

(52) U.S. Cl.
CPC ..... *E04F 10/10* (2013.01); *E04C 3/07* (2013.01); *E04C 3/127* (2013.01); *E04C 3/28* (2013.01); *E04F 10/00* (2013.01); *E04B 2001/2415* (2013.01); *E04B 2001/2421* (2013.01); *E04B 2001/2454* (2013.01); *E04C 3/12* (2013.01);
(Continued)

(58) Field of Classification Search
CPC .... E04C 3/07; E04C 3/127; E04C 3/28; E04F 10/00; E04B 1/2403
See application file for complete search history.

(56) References Cited

U.S. PATENT DOCUMENTS 4,024,691 A * 5/1977 Hansen ..... E06B 3/9645 52/656.9
6,331,092 B1 * 12/2001 Linger ..... E04B 2/761 403/367
(Continued)

*Primary Examiner* — Daniel J Wiley
(74) *Attorney, Agent, or Firm* — Fresh IP PLC; Aubrey Y Chen

(57) ABSTRACT

Screen device in which two beams (1, 2) in the mounted state of the screen device are mutually coupled with the aid of: —a first coupling piece (3), comprising a first mounting cavity (4) for the fitting herein of a first part of the first beam (1); and a second mounting cavity (5) for the fitting herein of a first part of the second beam (2); —and a second coupling piece (6), comprising a first mounting cavity (7) for the fitting herein of a second part of the first beam (1), extending opposite the first part; and a second mounting cavity (8) for the fitting herein of a second part of the second beam (2), extending opposite the first part.

13 Claims, 4 Drawing Sheets

(51) Int. Cl.

| | |
|---|---|
| ***E04C 3/07*** | (2006.01) |
| ***E04C 3/28*** | (2006.01) |
| ***E04F 10/00*** | (2006.01) |
| *E04C 3/04* | (2006.01) |
| *E04B 1/24* | (2006.01) |

(52) U.S. Cl.
CPC *E04C 2003/046* (2013.01); *E04C 2003/0421* (2013.01); *E04C 2003/0439* (2013.01); *E04C 2003/0465* (2013.01)

(56) References Cited

U.S. PATENT DOCUMENTS

| | | | | |
|---|---|---|---|---|
| 6,926,613 | B1 * | 8/2005 | Binning | A63D 15/00 108/158 |
| 2002/0006312 | A1 * | 1/2002 | Buard | H02G 3/0608 403/403 |
| 2005/0129460 | A1 * | 6/2005 | Medcalf | E06B 3/5454 403/403 |

* cited by examiner

SCREEN DEVICE

This application claims the benefit of Belgian patent application No. BE2015/5334, filed May 28, 2015, which is hereby incorporated by reference in its entirety.

FIELD OF THE DISCLOSURE

Embodiments of this invention relate to a screen device, comprising a plurality of beams, which in the mounted state of the screen device are mutually coupled with the aid of fastening means.

BACKGROUND

The beams of a screen device of this type here typically form part of a canopy. Screen devices of this type are generally arranged to shield, or, conversely, expose, an outside place. Such screen devices are frequently erected in homes, restaurants, shops and the like in order to shield an outside terrace or the like from rays of the sun, precipitation and/or wind, or, conversely, to let in rays of the sun just temporarily. These screen devices can be designed in the form of awnings, pergolas, verandas, terrace canopies, carports, etc.

A screen construction of this type typically comprises a roof construction (canopy), which is normally at least partially supported by columns. The canopy usually comprises a plurality of beams as construction elements, which are put together to form one or more frameworks. A framework of this type is typically supported on four (or more) columns, or else is typically fastened on one or more sides to a wall, for supporting purposes, and supported on another side by one, two (or more) columns. The columns are (in addition to the beams) construction elements of the screen device.

The canopy can be of fixed design, or can comprise a screen which is capable of being rolled up and unrolled, or can comprise slats, etc., which can be rotatable and/or movable or not.

In order to mutually couple the beams in such screen devices, they are often mutually welded or mutually bolted with the aid of angle sections.

The mutual welding of the beams can usually be carried out only with difficulty at the site where the screen device needs to be installed. In this way, mutually coupled beams together form large construction elements which, when these are assembled in a workshop, can often be brought only with difficulty to the site where the screen device needs to be installed. Nor is this joining technique usually afforded to do-it-yourselfers who wish to erect such a screen device.

Most angle sections and bolts are fitted externally, which is often undesirable for aesthetic reasons. Angle sections which are fitted internally and deliver an aesthetic result do exist, but it is not particularly easy to mutually couple beams herewith. This solution is hence not very suitable for do-it-yourselfers.

Hence several solutions have already been devised to be able to mutually couple beams on the spot in an easier manner, without the use of disturbing, externally visible fastening means such as angle sections and bolts.

In BE 1 019 767 A3 is described, for example, how beams of this type can be fastened to a column in order to mutually couple these, wherein the column consists of a plurality of parts. The beams are firstly screwed to an angle section of the column, after which an end profile closes off the column, so that the screws are received in the column and are hidden from view.

In BE 2014/0015 is described how end plates are fastened to the ends of the beams with the aid of screws, how these end plates are then mutually coupled with the aid of angle sections and screws, and how the corner angle of these mutually coupled beams is screened with the aid of an end element, whereby all fastening means are accommodated in this corner angle and are hidden from view by virtue of the end element.

In these various solutions, a lot of fastening means are necessary to be able to mutually couple the beams, and end elements are then necessary to hide these fastening means from view. This method of coupling the beams is very laborious and very expensive. Nor is this coupling method very suitable for do-it-yourselfers who wish to erect such a canopy themselves.

SUMMARY

An object of this invention is to provide a solution for being able to mutually couple the beams of a screen device on the spot, without the use of aesthetically disturbing, external fastening means, which solution is less complex, less laborious and less expensive.

This object of the invention may be achieved by providing a screen device comprising a plurality of beams, which in the mounted state of the screen device are mutually coupled with the aid of fastening means, which fastening means:

- comprise a first coupling piece, which
  - comprises a first mounting cavity, for the fitting herein of a first part of a first said beam;
  - and comprises a second mounting cavity, for the fitting herein of a first part of a second said beam;
- and comprise a second coupling piece, which
  - comprises a first mounting cavity, for the fitting herein of a second part of the first beam, which extends opposite the said first part of the first beam;
  - and comprises a second mounting cavity, for the fitting herein of a second part of the second beam, which extends opposite the said first part of the second beam.

With the aid of these coupling pieces, beams of a screen device can be more easily mutually coupled, this also by do-it-yourselfers and this in principle also by one individual, where the existing solutions require several persons to be able to mount the beams.

Given that the said mutually oppositely situated parts of the beams are fittable in mounting cavities of the coupling pieces, in the mounted state at least one of the two coupling pieces will extend at least partially on the bottom side of the beams, and at least one of the two coupling pieces will extend at least partially on the top side of the beams. In this case, it can always be ensured—for the simplicity of the further explanation—that the coupling piece denoted as the first coupling piece extends at least partially on the bottom side of the beams, and the coupling piece denoted as the second coupling piece extends at least partially on the top side of the beams.

The first coupling piece can, for example, firstly be fastened to a wall or on top of a column etc. The beams can then be fitted into this first coupling piece, wherein they will be at least partially supported by this coupling piece, given that this coupling piece extends at least partially on their bottom side. During the further assembly, they do not need to be raised manually or with external aids, but can rest on this first coupling piece. Also when the first coupling piece is not fastened to a wall or on top of a column etc., it can be supported with external aids, in which case this coupling piece can in turn support the beams, which is easier than the supporting of both beams. This can now also be carried out by one individual. After this, the second coupling piece can easily be fitted at the top of the beams in order to secure these in the other directions also.

The beams can be correctly positioned and secured with the aid of the first coupling piece in one action. With a coupling piece of this type, it can easily be ensured that no further alignment of the beams with respect to one another is necessary to obtain a good connection and to give the whole an aesthetic finish. The alignment and aesthetic finishing of the connection can be fully defined with the aid of the coupling pieces.

With the aid of these coupling pieces, far fewer actions are necessary to mutually couple the beams. The assembly of these beams in the screen device can be realized much more comfortably. This assembly is in principle also possible without making holes in the beams. As further becomes clear, in a preferred embodiment some openings are provided in the beams in order to further improve the assembly.

The finishing of the whole is cheaper. These coupling pieces extend along the outer side of the beams, but are much easier to aesthetically coordinate with the beams than auxiliary profiles and bolts or screws, which can form one aesthetic whole with the beams only with greater difficulty.

Coupling pieces of this type can be provided both for beams which connect to one another at an angle and for beams which connect to one another in the extension of one another, as well as for beams which connect to one another in a T-shape or X-shape. If the beams do not lie in the extension of one another, then in these connections respectively at least one of the beams will connect with its end (end face) preferably to a side edge (side face) of the other beam.

The mounting cavities of one and the same coupling piece are preferably designed as separate mounting cavities in order to be able to correctly position the beams in a comfortable manner. In principle, these mounting cavities can however also form part of one and the same cavity.

A said coupling piece can consist of a plurality of parts, but is preferably realized in one part.

In an easily mountable embodiment of a screen device according to this invention, the said first parts of the beams are bottommost parts of the respective beams, and the said second parts of the beams are topmost parts of the respective beams.

The mounting cavities of the coupling pieces of a screen device according to this invention preferably have a shape corresponding with the shape of the corresponding parts of the beams in order to be easily able to secure the beams as well as possible in these cavities. The mounting cavities are further preferably provided for the positive-locking fitting herein of the corresponding parts of the beams in order to make it thus easier to mutually couple the beams without, or with a minimum of, further fastening means.

In order to obtain a firm connection and to finish the whole aesthetically, when the corresponding beams are fitted in the corresponding cavities of the first coupling piece and in the corresponding cavities of the second coupling piece, the first coupling piece and the second coupling piece preferably connect to each other.

In order to be able to make these coupling pieces connect nicely to each other despite tolerance differences, they preferably at least partially overlap each other in the mounted state. In order to be able to realize this aesthetically, these coupling pieces, at the margins where they partially overlap each other, are preferably provided with complementary indentations.

Also for the sake of tolerance differences or in order to simplify the assembly and nevertheless obtain a firm connection, the fastening means preferably comprise coupling means for the mutual coupling of the first coupling piece and the second coupling piece.

Alternatively, coupling means could also be provided to further couple each coupling piece to the beams. However, this demands adjustments to the beams, which adjustments are not very desirable. The provision of coupling means for the mutual coupling of the coupling pieces can be realized more easily and more cheaply.

As coupling means can be provided, for example, click means.

More preferredly, each coupling piece comprises a partial screw channel as the coupling means, wherein these partial screw channels, when the corresponding beams are fitted in the corresponding cavities of the first coupling piece and in the corresponding cavities of the second coupling piece, form part of one and the same screw channel. The coupling means then further comprise a screw for screwing into this screw channel in order to mutually couple the coupling pieces.

With the aid of such screw channels and a screw, the coupling pieces can be firmly mutually connected in a simple manner.

Partial screw channels of this type are preferably arranged between the mounting cavities of the corresponding coupling piece, so that these additional coupling means can remain positioned outside the beams themselves, so that no openings need to be made in the beams in order to be able to mutually couple the coupling pieces.

In order to be able to accurately position the beams still more easily in the mounting cavities and to be further able to secure them, even in the case of relatively large tolerance differences, preferably at least one mounting cavity is delimited at the bottom by a bottom of the corresponding coupling piece, wherein this bottom is provided with a recess and/or an elevation and the corresponding part of the corresponding beam is provided with an elevation and/or recess corresponding with this recess and/or elevation.

By 'at the bottom' is here meant at the bottom of the mounting cavity itself. In a second coupling piece in which a topmost part of a beam is fittable in the respective mounting cavity, this bottom, in the mounted state of the screen device, will then of course be found at the top of the coupling piece.

Such recesses and corresponding elevations serve as positioning elements for the positioning of the particular components with respect to one another.

It is also possible to provide a plurality of such recesses and/or elevations per mounting cavity, this, for example, in order to be comfortably able to correctly position and secure a beam, given tolerance differences in several directions.

Such recesses and/or elevations can be variously designed.

Thus it is possible, for example, to provide a beam with a rib or a slot and to provide the corresponding coupling piece with a corresponding slot or rib. It is also possible to provide an opening in a beam and to provide the corresponding coupling piece with a corresponding projection.

In a preferred embodiment, the first coupling piece is provided with a threaded shaft as the said elevation, which extends with respect to the bottom of the first mounting cavity of the first coupling piece, and the first beam is provided with a corresponding opening as the said recess. This opening can easily be provided, for example, as a bore. In such an embodiment, the screen device can then advantageously also comprise a nut for screwing onto this threaded shaft in order thus to fix this beam with respect to this coupling piece.

If a screen device according to an embodiment of this invention comprises a column, which in the mounted state of the screen device is coupled to the beams, then the first coupling piece is preferably provided at the bottom with one or more positioning elements, which are fittable in and/or around the column so as to position this coupling piece with respect to the column in order to couple the beams to the column.

These one or more positioning elements preferably fit in a positive-locking manner in or around the column.

It is also possible to then additionally screw such a column with screws, for example, to these one or more positioning elements. Such screws are then preferably provided on one or more sides of the column which in the mounted state are hidden from view.

Preferably, one or more positioning elements of this type are provided for fitting in the column. In this way, it is easier to make the outer walls of the first coupling piece connect to the outer walls of the column in order thus to obtain an aesthetic connection of the first coupling piece to the column. In order to be able to fit these one or more positioning elements in the column, this column is preferably, to this end, of hollow design.

In a specific embodiment of a screen device according to this invention, each coupling piece comprises a first virtually U-shaped leg, which delimits the first mounting cavity, and a second virtually U-shaped leg, which delimits the second mounting cavity.

In a preferred embodiment of a screen device according to this invention, each mounting cavity is designed such that it narrows towards a bottom, which delimits this mounting cavity at the bottom, and each beam is designed correspondingly curved.

By 'at the bottom' is here meant at the bottom of the mounting cavity itself. In a second coupling piece, in which a topmost part of a beam is fittable in the respective mounting cavity, this bottom, in the mounted state of the screen device, will then of course be found at the top of the coupling piece.

When the mounting cavities are designed so as to narrow in this way, it is easier to fit a beam into such a cavity, given that the corresponding side of the beam is then narrower than the access opening to this cavity. Moreover, this beam is then further guided, in a self-centring manner, by the converging walls of such a mounting cavity, into the correct end position.

By designing each beam correspondingly curved, the beams can be fitted with a minimum of clearance in these mounting cavities, so that the coupling pieces abut nicely against the beams.

If such a coupling piece is produced as a casting or moulding, then the draft angle which is inherently present in order to produce this coupling piece can be sufficient to realize the necessary taper of the mounting opening.

The coupling pieces of a screen device according to an embodiment of this invention are preferably produced as such a casting or moulding, given that such a coupling piece can be easily produced in this manner.

In a screen device according to an embodiment of this invention, the first beam and the second beam will typically be arranged at an angle with respect to each other. The corresponding mounting cavities are then preferably arranged at this same angle with respect to each other.

If two such beams connect to each other at a virtually perpendicular angle, then the coupling pieces are preferably of virtually L-shaped configuration. In this case, the first beam preferably connects with an end (end face) to a side edge (side face) of the second beam. If a third beam connects at a virtually perpendicular angle to two such beams, then the coupling pieces are preferably of virtually T-shaped configuration. In this case, the third beam preferably connects with an end (end face) to a side edge (side face) of the second beam. If also a fourth beam connects at a virtually perpendicular angle to three such beams, then the coupling pieces are preferably of virtually cruciform configuration. In this case, the first and the third beam preferably connect with an end (end face) partially to a side edge of the second beam and partially to a side edge of the fourth beam.

If three beams in a screen device according to an embodiment of this invention connect to one another, then the first coupling piece preferably comprises a third mounting cavity, for the fitting herein of a first part of the third said beam, and the second coupling piece preferably comprises a third mounting cavity, for the fitting herein of a second part of the third beam, which extends opposite the said first part of the third beam.

In the case of a plurality of beams which connect to one another, both coupling pieces of a screen device according to an embodiment of this invention each preferably comprise as many corresponding mounting cavities as there are beams.

BRIEF DESCRIPTION OF THE DRAWINGS

This invention is now explained in greater detail on the basis of the hereinafter following detailed description of some preferred embodiments of a screen device according to this invention. The aim of this description is solely to provide illustrative examples and to indicate further advantages and particularities of this invention, and thus cannot be interpreted as a limitation of the field of application of the invention or of the patent rights claimed in the claims.

In this detailed description, reference is made by means of reference numerals to the accompanying drawings, wherein in FIG. 1 a connection of two beams from a screen device according to this invention at an angle with respect to each other and on top of a column is represented in perspective.

DETAILED DESCRIPTION

Figure 1:
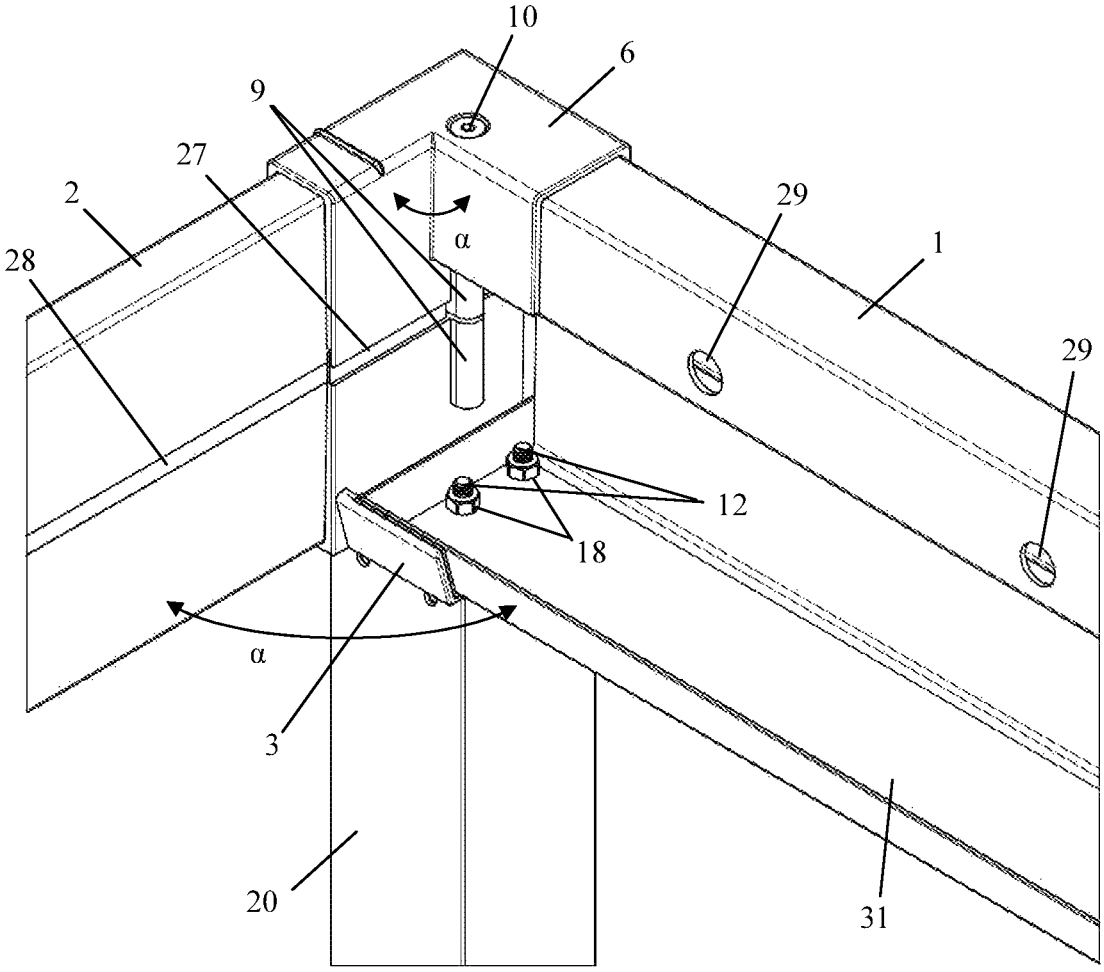

In the figures can be seen a connection of two beams (1, 2) from a screen device according to this invention on top of a column (20).

Such a screen device comprises a plurality of such beams (1, 2), which are put together to form a framework. This framework can be mounted on columns (20) or partially on, for example, a wall.

In such a screen device, the space in the framework is filled with filling elements, which may be arranged displaceably or not. Displaceable filling elements are typically slats, which can be rolled up and unrolled on a screen roller and/or are tiltable and/or movable, etc. The displaceable elements preferably form in closed position a watertight roof. By displacement and/or rotation of slats and/or by rolling-up of a screen, this roof can be at least partially opened and/or closed in order thus, according to choice, to let through, or, conversely, shield against, sun and/or wind.

In order to fasten the beams (1, 2) on top of the column (20), the screen device according to the invention comprises a first coupling piece (3) and a second coupling piece (6).

Figure 2:
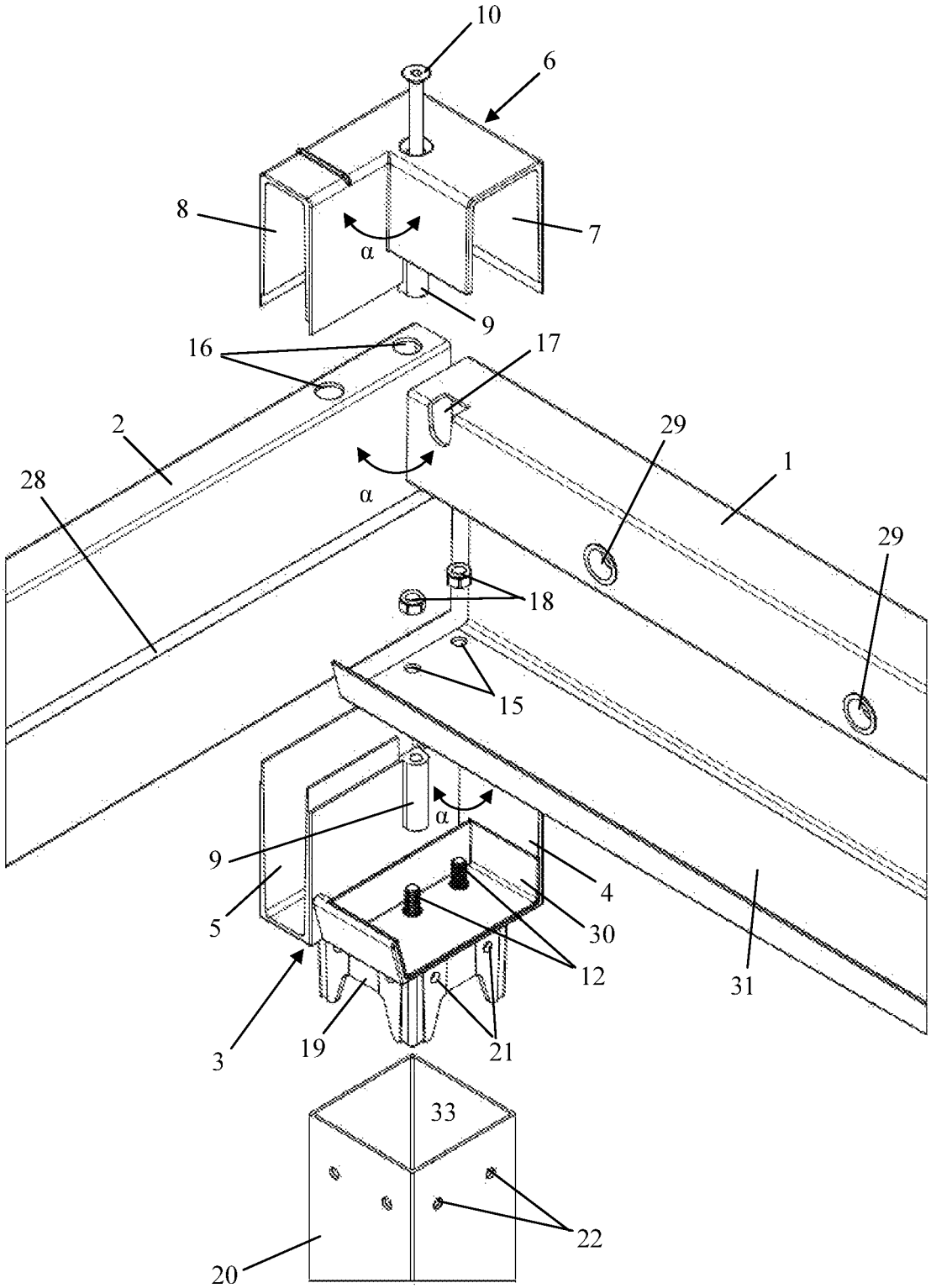
FIG. 2 the connection from FIG. 1 is represented in exploded perspective.

The depicted first coupling piece (3) is provided with a positioning element (19), which is fittable in the cavity (33) of the hollow designed column (20), as can be seen in FIG. 2. The positioning element (19) has a shape adapted to the shape of the cavity (33) of the column (20), so that it fits virtually in a positive-locking manner herein. In order to fix the coupling piece (3) with respect to the column (20) despite possible clearances as a result of tolerance differences, both this positioning element (19) and the column (20) are further provided with bores (21 and 22 respectively), through which screws are fittable for screwing of the column (20) to this positioning element (19). The bores (22) in the column (20) are provided on those sides of this column (20) which in the mounted state of the screen device are directed towards the inner side of the canopy, so that these are largely hidden from view.

Figure 3:
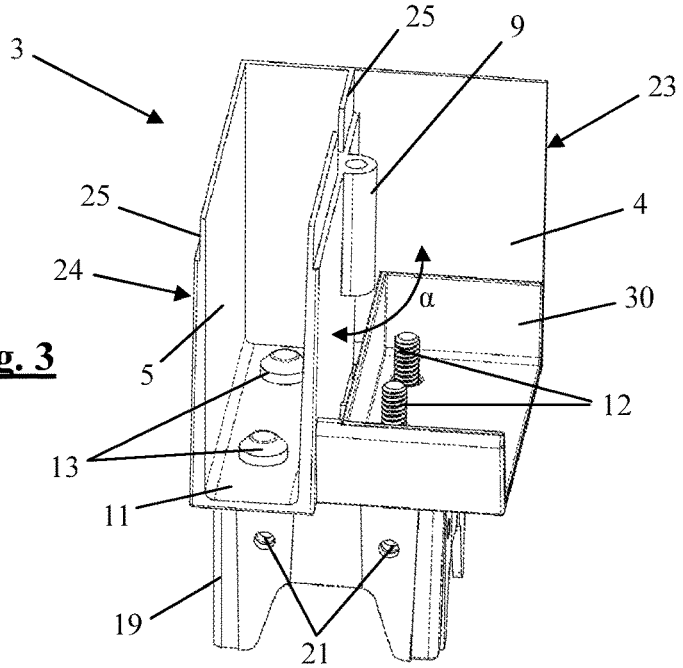
FIG. 3 the first coupling piece from FIG. 1 is represented separately in perspective.

The first coupling piece (3) further comprises a first U-shaped leg (23) and a second U-shaped leg (24), as can clearly be seen in FIG. 3. The first U-shaped leg (23) demarcates a first mounting cavity (4) for the fitting herein of the first beam (1), as can be seen in FIGS. 1 and 2. The second U-shaped leg (24) analogously demarcates a second mounting cavity (5) for the fitting herein of the second beam (2). The U-shaped legs (23, 24) connect to each other at a virtual right angle ($\alpha$), such that the beams (1, 2), when they are fitted in the said mounting cavities (4, 5), extend at this same angle ($\alpha$) with respect to each other.

The mounting cavities (4, 5) are designed such that they narrow towards the bottom (11) of the U-shaped legs (23, 24). The beams (1, 2) comprise corresponding curved side walls (32). These curved beams (1, 2) widen towards the middle of the beams (1, 2), as can be seen more clearly in FIGS. 6-9, so that the bottommost part of these beams (1, 2) can be fitted in a positive-locking manner into the narrowing mounting cavities (4, 5) of this first coupling piece (3).

By virtue of the taper and corresponding curvature (32), the beams (1, 2) can be fitted in a self-centring manner into these mounting cavities (4, 5).

Into the first leg (23) of the first coupling piece (3) are worked two threaded shafts (12), which extend upwards with respect to the bottom (11) of the leg (23). The first beam (1) is provided with two corresponding bores (15), through which these threaded shafts (12) are fittable. These threaded shafts (12) and corresponding bores (15) thus form positioning elements (12, 15), with which the first beam (1) can be correctly positioned with respect to the first coupling piece (3). The fact that the positioning elements (12) of the first leg (23) are designed as threaded shafts (12) means that nuts (18) can also be turned hereon in order thus to bolt the first beam (1) to the first coupling piece (3) with the aid of these threaded shafts (12) and nuts (18).

In the second leg (24) of the first coupling piece (3) are provided two projecting knobs (13), which extend upwards with respect to the bottom (11) of the leg (24). The second beam (2) is provided with two corresponding bores (16), through which these knobs (13) are fittable. The knobs (13) and bores (16) thus form positioning elements (13, 16), with which the second beam (2) can be correctly positioned with respect to the first coupling piece (3).

Following fitting of the beams (1, 2) in the first coupling piece (3), the second coupling piece (6) can be mounted. The second coupling piece (6) likewise comprises a first U-shaped leg (23) and a second U-shaped leg (24), as can clearly be seen in FIGS. 4 and 5. The first U-shaped leg (23) demarcates a first mounting cavity (7) for the fitting herein of the first beam (1), as can be seen in FIGS. 1 and 2. The second U-shaped leg (24) demarcates a second mounting cavity (8) for the fitting herein of the second beam (2). Also these U-shaped legs (23, 24) connect to each other at the same virtual right angle ($\alpha$) as the legs (23, 24) of the first coupling piece (3) and the beams (1, 2).

Also the mounting cavities (7, 8) of this second coupling piece (6) are designed such that they narrow towards the bottom (11) of the U-shaped legs (23, 24), so that now the topmost part of the curved beams (1, 2) can be fitted in a positive-locking manner into the narrowing mounting cavities (7, 8) of this second coupling piece (6).

In the first leg (23) of the second coupling piece (3) is provided a projection (14), which extends upwards with respect to the bottom (11) and a side wall of the leg (23). The first beam (1) is provided with a corresponding opening (17), through which this projection (14) is fittable. This projection (14) and this corresponding opening (17) thus form positioning elements (14, 17), with which the first beam (1) can be correctly positioned with respect to the second coupling piece (6).

In the second leg (24) of the second coupling piece (6) are once again provided two projecting knobs (13), which extend upwards with respect to the bottom (11) of the leg (24). The second beam (2) is provided with two corresponding bores (16), through which these knobs (13) are fittable. The knobs (13) and bores (16) thus form positioning elements (13, 16), with which the second beam (2) can be correctly positioned with respect to the second coupling piece (6).

In order to make the first coupling piece (3) and the second coupling piece (6) connect nicely to each other, those margins of the first coupling piece (3) which are directed towards the second coupling piece (6) are provided on their outer side provided with an indentation (25). Those margins of the second coupling piece (6) which are directed towards the first coupling piece (3) are provided on their inner side with a complementary indentation (26), such that, when the second coupling piece (6) is fitted on top of the first coupling piece (3), these margins partially overlap each other. For aesthetic reasons, these margins do not fully overlap each other, so that a slot (27) extends in the thus shaped wall, as can be seen in FIG. 1. As a result of tolerance differences, it would namely not be possible to make these margins connect perfectly to each other, which without such a slot (27) may be felt to be aesthetically disturbing.

The beams (1, 2) are provided with corresponding slots (28), which in the mounted state extend in the extension of the slots (27) formed with the coupling pieces (3, 4), in order thus to form an aesthetic whole.

Figure 4:
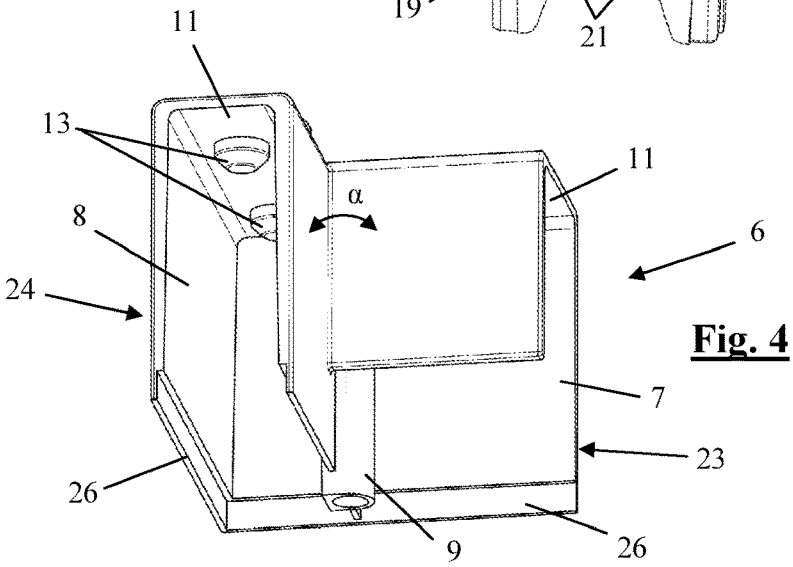
FIG. 4 the second coupling piece from FIG. 1 is represented separately in perspective, with a view of the second mounting cavity.
Figure 5:
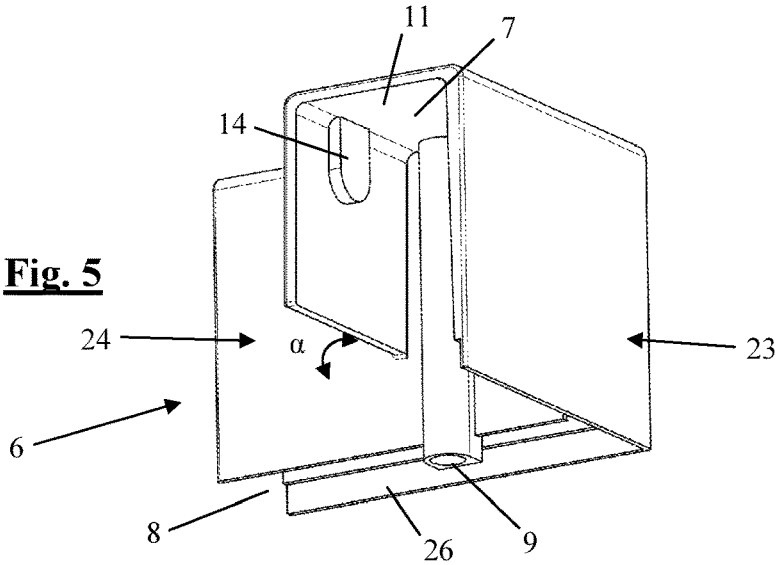
FIG. 5 the second coupling piece from FIG. 1 is represented separately in perspective, with a view of the first mounting cavity.
Figure 6:
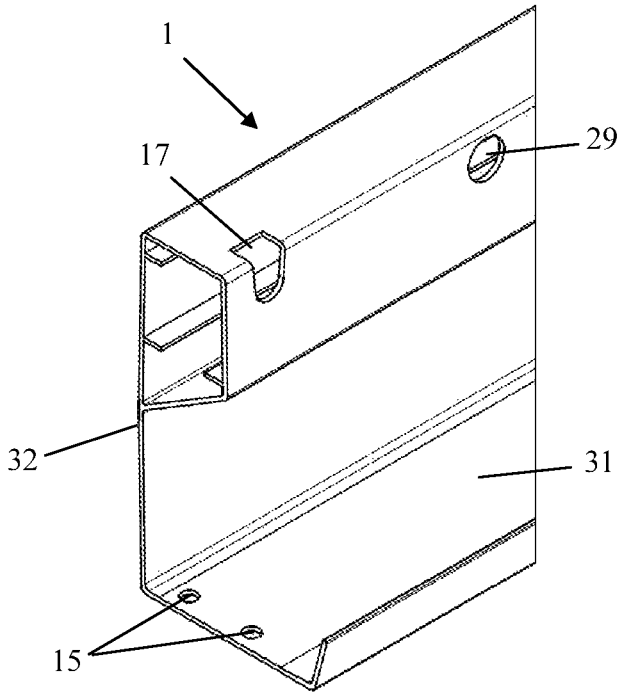
FIG. 6 the first beam from FIG. 1 is represented separately in perspective.
Figure 7:
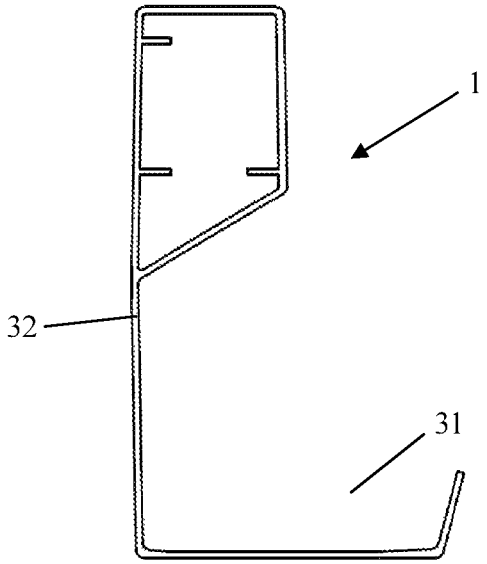
FIG. 7 the first beam from FIG. 1 is represented separately in cross section.
Figure 8:
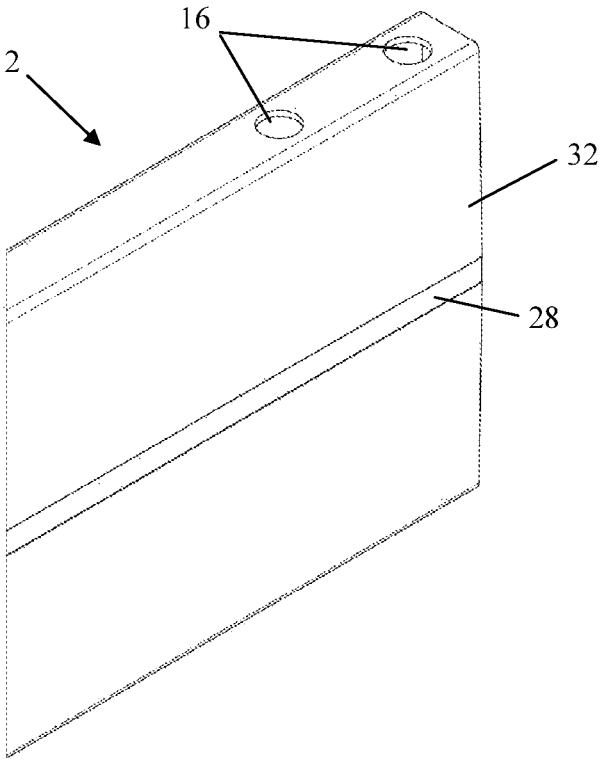
FIG. 8 the second beam from FIG. 1 is represented separately in perspective.
Figure 9:
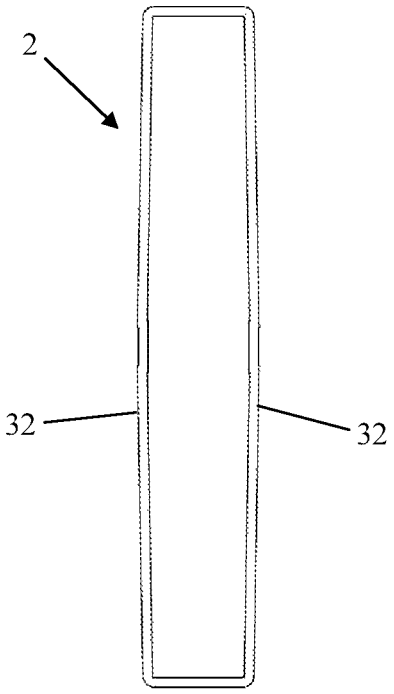
FIG. 9 the second beam from FIG. 1 is represented separately in cross section.

The depicted connection further comprises coupling means (9, 10), with which the first coupling piece (3) and the second coupling piece (6) can be mutually coupled after the beams (1, 2) have been fitted in the first coupling piece (3) and the second coupling piece (6) has been fitted above the beams (1, 2). To this end, these coupling means (9, 10) comprise a screw channel (9), consisting of two partial screw channels (9) which each form part of one of the two coupling pieces (3, 6), as can be seen in FIGS. 3-5. When the coupling pieces (3, 6) are fitted one on top of the other, these partial screw channels (9) form one screw channel (9), into which a screw (10) of the coupling means (9, 10) can be screwed in order thus to connect the two coupling pieces (3, 6) one to the other.

The depicted first beam (1) is provided with a side gutter (31). A side gutter (31) is typically present in screen devices in which the canopy is provided with moving parts which temporarily close off or, conversely, open the canopy, such as a roll-up and unrollable screen, or rotatable and/or displaceable slats, etc. This side gutter (31) here needs to extend under the lateral ends of the moving parts in order that precipitation which falls onto these moving parts can be led away to this side gutter (31). The depicted first beam (1) is here provided with bores (29) for the fitting herein of shafts of rotatable slats acting as such moving parts, which shafts are rotatable with respect to this beam (1). In order to make the side gutter (31) connect in a watertight manner to the first coupling piece (3), a seal (30) is provided in the first mounting cavity (4) of this first coupling piece (3), as can be seen in FIGS. 1-3.

The depicted beams (1, 2) and the depicted column (20) are designed as extruded profiles. These can be produced, for example, from aluminium or plastic. It is also possible to produce beams (1, 2) and/or columns (20) of a screen device according to this invention in other ways. These can then, for example, also be produced from other materials, such as, for example, steel, stainless steel, or wood, etc.

The depicted coupling pieces (3, 6) are produced as plastic mouldings. The taper of the mounting cavities (4, 5, 7, 8) is in this case provided as the draft angle for the production of these coupling pieces (3, 6).

Of course, it is also conceivable to produce such coupling pieces (3, 6) in other ways and/or from other materials.

The invention claimed is:

1. A screen device comprising a plurality of beams, wherein in a mounted state of the screen device said beams are mutually coupled with the aid of fasteners wherein said screen device comprises:

a first coupling piece, comprising:

a first mounting cavity for the fitting therein of a first part of a first beam; and a second mounting cavity for the fitting therein of a first part of a second beam; and a first channel between said first and second mounting cavities of said first coupling piece and extending transverse to said beams;

a second coupling piece, comprising:

a first mounting cavity for the fitting therein of a second part of the first beam, which extends opposite said first part of the first beam; and a second mounting cavity for the fitting therein of a second part of the second beam, which extends opposite said first part of the second beam; and a second channel between said first and second mounting cavities of said second coupling piece, and extending transverse to said beams;

wherein in the mounted state, the first and second channels mate to form a screw channel; and a fastener extending through said screw channel.

2. A screen device according to claim 1, characterized in that said first parts are bottommost parts of the respective beams, and in that said second parts are topmost parts of the respective beams.

3. A screen device according to claim 1, characterized in that said mounting cavities have a shape corresponding with the shape of the corresponding parts of the beams.

4. A screen device according to one claim 1, characterized in that the mounting cavities are provided for the positive-locking fitting therein of the corresponding parts of the beams.

5. A screen device according to claim 1, characterized in that, when the corresponding beams are fitted in the corresponding cavities of the first coupling piece and in the corresponding cavities of the second coupling piece, the first coupling piece and the second coupling piece connect to each other.

6. A screen device according to claim 1, characterized in that at least one mounting cavity is delimited at the bottom by a bottom of the corresponding coupling piece, wherein this bottom is provided with a recess and/or an elevation, and in that the corresponding part of the corresponding beam is provided with an elevation and/or recess corresponding with this recess and/or elevation.

7. A screen device according to claim 6, characterized in that the first coupling piece is provided with a threaded shaft as the said elevation, which extends with respect to the bottom of the first mounting cavity of the first coupling piece, and in that the first beam is provided with a corresponding opening as the said recess.

8. A screen device according to claim 1, characterized in that the screen device comprises a column, which in the mounted state of the screen device is coupled to the beams, and in that the first coupling piece is provided at the bottom with one or more positioning elements, which are fittable in and/or around the column so as to position this coupling piece with respect to the column in order to couple the beams to the column.

9. A screen device according to claim 1, characterized in that each coupling piece comprises a first virtually U-shaped leg, which delimits the first mounting cavity, and comprises a second virtually U-shaped leg, which delimits the second mounting cavity.

10. A screen device according to claim 1, characterized in that each mounting cavity narrows towards a bottom, which delimits each mounting cavity at the bottom, and in that each beam is correspondingly curved.

11. A screen device according to claim 1, characterized in that the coupling pieces are castings or mouldings.

12. A screen device according claim 1, characterized in that the first beam and the second beam are arranged in the screen device at an angle ($\alpha$) with respect to each other, and in that the corresponding mounting cavities are arranged at this same angle ($\alpha$) with respect to each other.

13. A screen device according to claim 1, characterized in that the first coupling piece comprises a third mounting cavity, for the fitting therein of a first part of a third beam, and in that the second coupling piece comprises a third mounting cavity, for the fitting therein of a second part of the third beam, which extends opposite the first part of the third beam.

* * * * *